US006490855B1

(12) United States Patent
Bidner et al.

(10) Patent No.: US 6,490,855 B1
(45) Date of Patent: Dec. 10, 2002

(54) FUELING CONTROL DURING EMISSION CONTROL DEVICE PURGING

(75) Inventors: David Karl Bidner, Livonia, MI (US); Gopichandra Surnilla, West Bloomfield, MI (US); Imad Hassan Makki, Dearborn Heights, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/544,318

(22) Filed: Apr. 6, 2000

(51) Int. Cl.[7] ..... F01N 3/00
(52) U.S. Cl. ..... 60/274; 60/276; 60/285
(58) Field of Search ..... 60/274, 276, 285, 60/286, 295; 204/425

(56) References Cited

U.S. PATENT DOCUMENTS 4,761,950 A * 8/1988 Nagai et al. ..... 60/274
5,361,582 A * 11/1994 Uchida et al. ..... 60/285
5,483,795 A * 1/1996 Katoh et al. ..... 60/285
5,778,666 A * 7/1998 Cullen et al. ..... 60/274
5,839,275 A * 11/1998 Hirota et al. ..... 60/285
6,101,809 A * 8/2000 Ishizuka et al. ..... 60/285
6,134,883 A * 10/2000 Kato et al. ..... 60/285
6,141,960 A * 11/2000 Takami et al. ..... 60/286
6,148,612 A * 11/2000 Yamashita et al. ..... 60/285
6,173,571 B1 * 1/2001 Kaneko et al. ..... 60/285
6,214,207 B1 * 4/2001 Miyata et al. ..... 204/425
6,263,666 B1 * 7/2001 Kubo et al. ..... 60/295

FOREIGN PATENT DOCUMENTS

EP 0733786 A2 9/1996

* cited by examiner

*Primary Examiner*—Thomas Denion
*Assistant Examiner*—Tu M. Nguyen
(74) *Attorney, Agent, or Firm*—Allan J. Lippa; John D. Russell

(57) ABSTRACT

A method for purging a catalyst containing oxidants operates the engine at different air-fuel ratios during different intervals. The intervals are adaptively adjusted based on a model that predicts an amount of fuel needed to perform the purging. The intervals are also responsive to an exhaust gas sensor located downstream of the catalyst.

4 Claims, 6 Drawing Sheets

FUELING CONTROL DURING EMISSION CONTROL DEVICE PURGING

FIELD OF THE INVENTION

The invention relates to a system and method for controlling an internal combustion engine coupled to an emission control device.

BACKGROUND OF THE INVENTION

Engine and vehicle fuel efficiency can be improved by lean burn internal combustion engines. To reduce emissions, these lean burn engines are coupled to emission control devices known as three-way catalytic converters optimized to reduce CO, HC, and NOx. When operating at air-fuel ratio mixtures lean of stoichiometry, another three way catalyst known as a NOx trap or catalyst is typically coupled downstream of the three-way catalytic converter, where the NOx trap is optimized to further reduce NOx. The NOx trap typically stores NOx when the engine operates lean and releases NOx to be reduced when the engine operates rich or stoichiometry.

One method for controlling air-fuel ratio to release, or purge, stored NOx operates the engine rich until an air-fuel sensor downstream of the NOx trap indicates a rich air-fuel ratio. In other words, while the air-fuel ratio entering the NOx trap is rich, the output air-fuel ratio exiting the NOx trap will be near stoichiometry until a majority of the stored NOx is released. When the air-fuel ratio downstream becomes rich, there is little stored NOx and thus hydrocarbons are not used to reduce NOx and exit. Stated another way, the NOx trap is purged of stored NOx. Then, the engine air-fuel ratio can again become lean and the NOx trap can again store NOx. Such a system is described in EP 733786.

The inventors herein have recognized a disadvantage of the above approach. In particular, when the air-fuel sensor is placed downstream of the NOx trap, there is always extra fuel used. In other words, since there is a delay from when fuel is injected until it reaches the air-fuel sensor, there will always be a certain amount of rich exhaust in the exhaust system when a purge is ended. All of the fuel in this bit of rich exhaust is excess and degrades fuel economy.

As an attempt to solve the above disadvantages, another approach is to place the air-fuel sensor somewhere in the NOx trap. In other words, the air-fuel sensor may be placed at a location two-thirds from the front of the NOx trap. In this way, there is still some catalyst material after the air-fuel sensor to use the excess fuel in the rich exhaust.

The inventors herein have recognized a further disadvantage with the above approach. In particular, to obtain optimum performance, the sensor location is dependent on exhaust mass flow. Stated another way, at high exhaust mass flows, the sensor should be located closer to the front of the catalyst since a greater amount of fuel will be stored in the exhaust. Similarly, at low exhaust mass flows, the sensor should be located closer to the rear of the catalyst. Since only a single location is practical, performance is degraded.

SUMMARY OF THE INVENTION

An object of the invention claimed herein is to provide a method for controlling an engine during emission control device purging.

The above object is achieved, and disadvantages of prior approaches overcome, by claim 1.

By using a less rich value to complete purging of the emission control device, only a small amount of fuel is stored in the exhaust system when a purge completion signal is obtained. Thus, minimal emissions are produced during purging. Also, total purge time is minimized since most purge fuel is supplied at the richer air-fuel ratio.

An advantage of the above aspect of the present invention is that over purging is minimized.

Another advantage of the above aspect of the present invention is that fuel economy is optimized while excess rich emissions are also minimized.

In another aspect of the present invention, the disadvantages of prior approaches are overcome by a method for controlling an internal combustion engine coupled to an emission control device with an exhaust sensor coupled downstream of the emission control device, the method comprising: operating the engine at a lean air-fuel ratio during a first interval, operating the engine at a first rich air-fuel ratio during a second interval following said first interval, and operating the engine at a second rich air-fuel ratio during a third interval following said second interval, wherein a duration of said second interval is based on a parameter indicative of a fuel quantity used during previously performed second and third intervals.

By adaptively adjusting the first rich interval, it is possible to account for catalyst aging, while minimizing the rich operating time.

Other objects, features and advantages of the present invention will be readily appreciated by the reader of this specification.

BRIEF DESCRIPTION OF THE DRAWINGS

The objects and advantages described herein will be more fully understood by reading an example of an embodiment in which the invention is used to advantage, referred to herein as the Description of Preferred Embodiment, with reference to the drawings, wherein.

DESCRIPTION OF THE INVENTION

Figure 1:
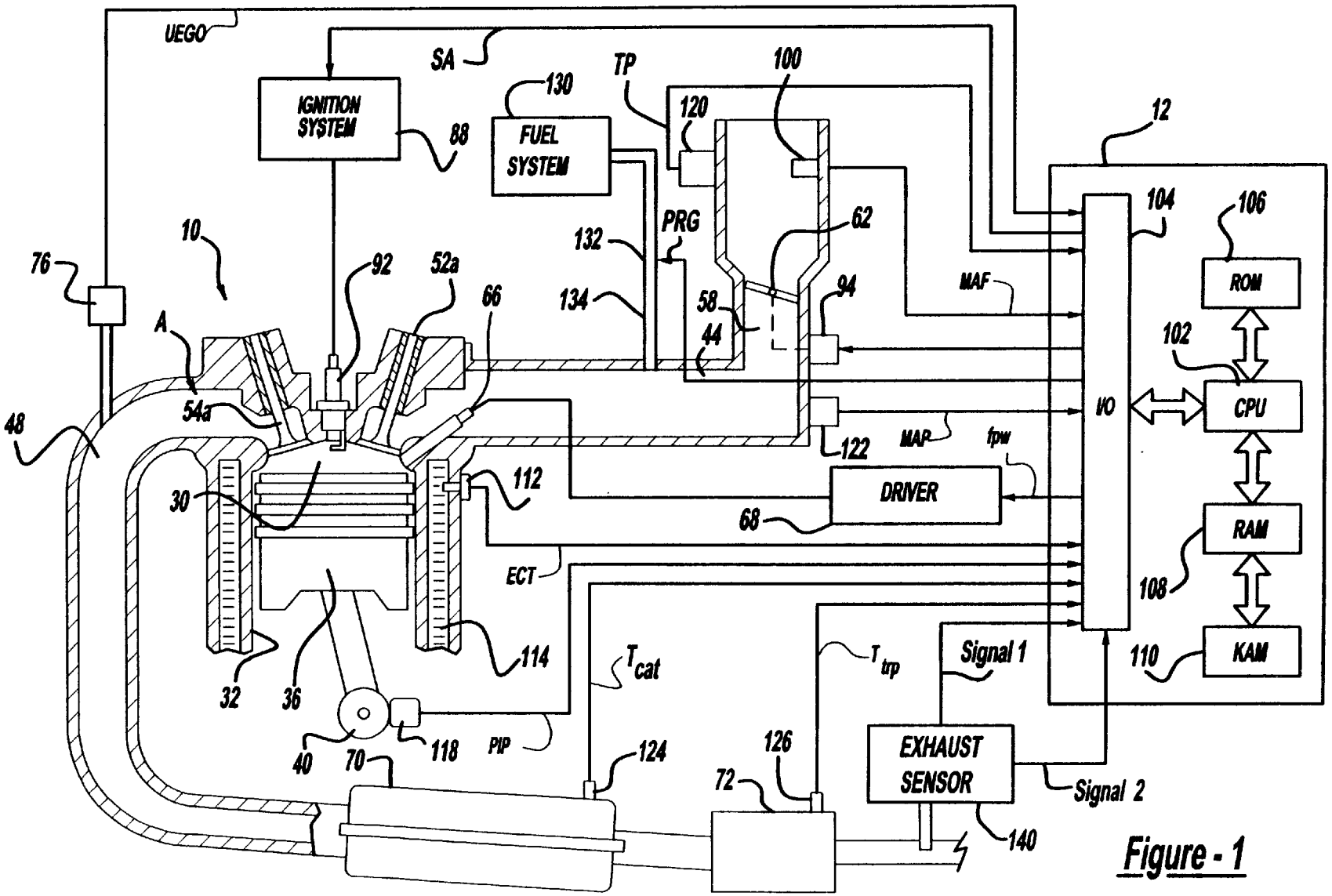
FIGS. 1 and 2 are block diagrams of embodiments wherein the invention is used to advantage.

Direct injection spark ignited internal combustion engine 10, comprising a plurality of combustion chambers, is controlled by electronic engine controller 12 as shown in FIG. 1. Combustion chamber 30 of engine 10 includes combustion chamber walls 32 with piston 36 positioned therein and connected to crankshaft 40. In this particular example, piston 36 includes a recess or bowl (not shown) to help in forming stratified charges of air and fuel. Combustion chamber 30 is shown communicating with intake manifold 44 and exhaust manifold 48 via respective intake valves 52*a* and 52*b* (not shown), and exhaust valves 54*a* and 54*b* (not shown). Fuel injector 66 is shown directly coupled to combustion chamber 30 for delivering liquid fuel directly therein in proportion to the pulse width of signal fpw received from controller 12 via conventional electronic driver 68. Fuel is delivered to fuel injector 66 by a conventional high pressure fuel system (not shown) including a fuel tank, fuel pumps, and a fuel rail.

Intake manifold 44 is shown communicating with throttle body 58 via throttle plate 62. In this particular example, throttle plate 62 is coupled to electric motor 94 so that the position of throttle plate 62 is controlled by controller 12 via electric motor 94. This configuration is commonly referred to as electronic throttle control (ETC) which is also utilized during idle speed control. In an alternative embodiment (not shown), which is well known to those skilled in the art, a bypass air passageway is arranged in parallel with throttle plate 62 to control inducted airflow during idle speed control via a throttle control valve positioned within the air passageway.

Exhaust gas oxygen sensor 76 is shown coupled to exhaust manifold 48 upstream of catalytic converter 70. In this particular example, sensor 76 provides signal UEGO to controller 12 which converts signal UEGO into a relative air-fuel ratio λ. Signal UEGO is used to advantage during feedback air-fuel ratio control in a manner to maintain average air-fuel ratio at a desired air-fuel ratio as described later herein. In an alternative embodiment, sensor 76 can provide signal EGO (not show) which indicates whether exhaust air-fuel ratio is either lean of stoichiometry or rich of stoichiometry.

Conventional distributorless ignition system 88 provides ignition spark to combustion chamber 30 via spark plug 92 in response to spark advance signal SA from controller 12.

Controller 12 causes combustion chamber 30 to operate in either a homogeneous air-fuel ratio mode or a stratified air-fuel ratio mode by controlling injection timing. In the stratified mode, controller 12 activates fuel injector 66 during the engine compression stroke so that fuel is sprayed directly into the bowl of piston 36. Stratified air-fuel ratio layers are thereby formed. The stratum closest to the spark plug contains a stoichiometric mixture or a mixture slightly rich of stoichiometry, and subsequent strata contain progressively leaner mixtures. During the homogeneous mode, controller 12 activates fuel injector 66 during the intake stroke so that a substantially homogeneous air-fuel ratio mixture is formed when ignition power is supplied to spark plug 92 by ignition system 88. Controller 12 controls the amount of fuel delivered by fuel injector 66 so that the homogeneous air-fuel ratio mixture in chamber 30 can be selected to be substantially at (or near) stoichiometry, a value rich of stoichiometry, or a value lean of stoichiometry. Operation substantially at (or near) stoichiometry refers to conventional closed loop oscillatory control about stoichiometry. The stratified air-fuel ratio mixture will always be at a value lean of stoichiometry, the exact air-fuel ratio being a function of the amount of fuel delivered to combustion chamber 30. An additional split mode of operation wherein additional fuel is injected during the exhaust stroke while operating in the stratified mode is available. An additional split mode of operation wherein additional fuel is injected during the intake stroke while operating in the stratified mode is also available, where a combined homogeneous and split mode is available.

Nitrogen oxide (NOx) absorbent or trap 72 is shown positioned downstream of catalytic converter 70. NOx trap 72 absorbs NOx when engine 10 is operating lean of stoichiometry. The absorbed NOx is subsequently reacted with HC and catalyzed during a NOx purge cycle when controller 12 causes engine 10 to operate in either a rich mode or a near stoichiometric mode.

Controller 12 is shown in FIG. 1 as a conventional microcomputer including: microprocessor unit 102, input/output ports 104, an electronic storage medium for executable programs and calibration values, shown as read-only memory chip 106 in this particular example, random access memory 108, keep alive memory 110, and a conventional data bus.

Controller 12 is shown receiving various signals from sensors coupled to engine 10, in addition to those signals previously discussed, including: measurement of inducted mass air flow (MAF) from mass air flow sensor 100 coupled to throttle body 58; engine coolant temperature (ECT) from temperature sensor 112 coupled to cooling sleeve 114; a profile ignition pickup signal (PIP) from Hall effect sensor 118 coupled to crankshaft 40 giving an indication of engine speed (RPM); throttle position TP from throttle position sensor 120; and absolute Manifold Pressure Signal MAP from sensor 122. Engine speed signal RPM is generated by controller 12 from signal PIP in a conventional manner and manifold pressure signal MAP provides an indication of engine load.

In this particular example, temperature Tcat of catalytic converter 70 and temperature Ttrp of NOx trap 72 are inferred from engine operation as disclosed in U.S. Pat. No. 5,414,994, the specification of which is incorporated herein by reference. In an alternate embodiment, temperature Tcat is provided by temperature sensor 124 and temperature Ttrp is provided by temperature sensor 126.

Fuel system 130 is coupled to intake manifold 44 via tube 132. Fuel vapors (not shown) generated in fuel system 130 pass through tube 132 and are controlled via purge valve 134. Purge valve 134 receives control signal PRG from controller 12.

Exhaust sensor 140 is a sensor that produces two output signals. First output signal (SIGNAL1) and second output signal (SIGNAL2) are both received by controller 12. Exhaust sensor 140 can be a sensor known to those skilled in the art that is capable of indicating both exhaust air-fuel ratio and nitrogen oxide concentration.

In one embodiment, SIGNAL1 indicates exhaust air-fuel ratio and SIGNAL2 indicates nitrogen oxide concentration. In this embodiment, sensor 140 has a first chamber (not shown) in which exhaust gas first enters where a measurement of oxygen partial pressure is generated from a first pumping current. Also, in the first chamber, oxygen partial pressure of the exhaust gas is controlled to a predetermined level. Exhaust air-fuel ratio can then be indicated based on this first pumping current. Next, the exhaust gas enters a second chamber (not shown) where NOx is decomposed and measured by a second pumping current using the predetermined level. Nitrogen oxide concentration can then be indicated based on this second pumping current.

Figure 2:
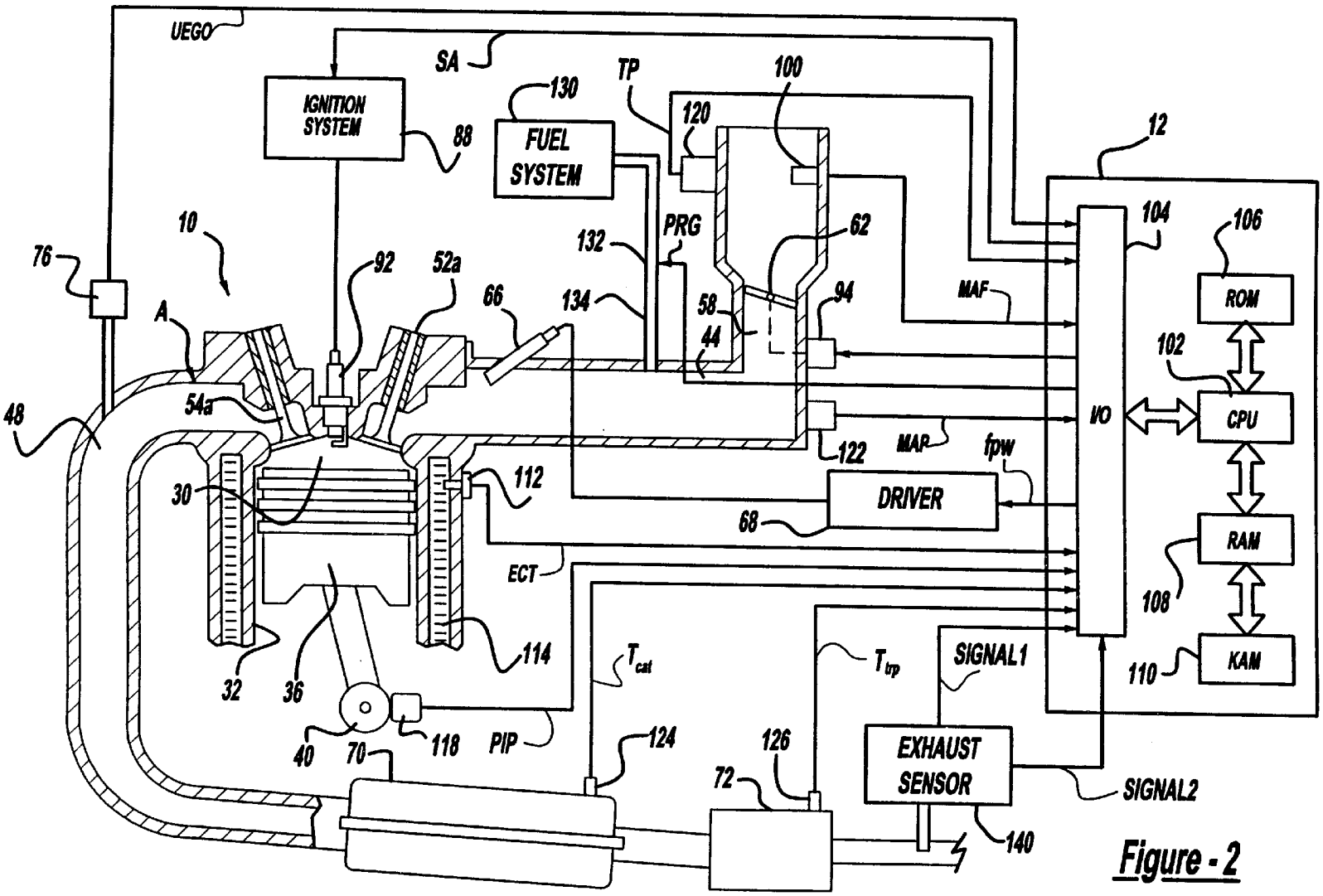

Referring now to FIG. 2, a port fuel injection engine 11 is shown where fuel is injected through injector 66 into intake manifold 44. Engine 11 is operated homogeneously substantially at stoichiometry, rich of stoichiometry, or lean of stoichiometry. Fuel is delivered to fuel injector 66 by a conventional fuel system (not shown) including a fuel tank, fuel pumps, and a fuel rail.

Those skilled in the art will recognize that the methods of the present invention can be used to advantage with either port fuel injected or directly injected engines.

Figure 3:
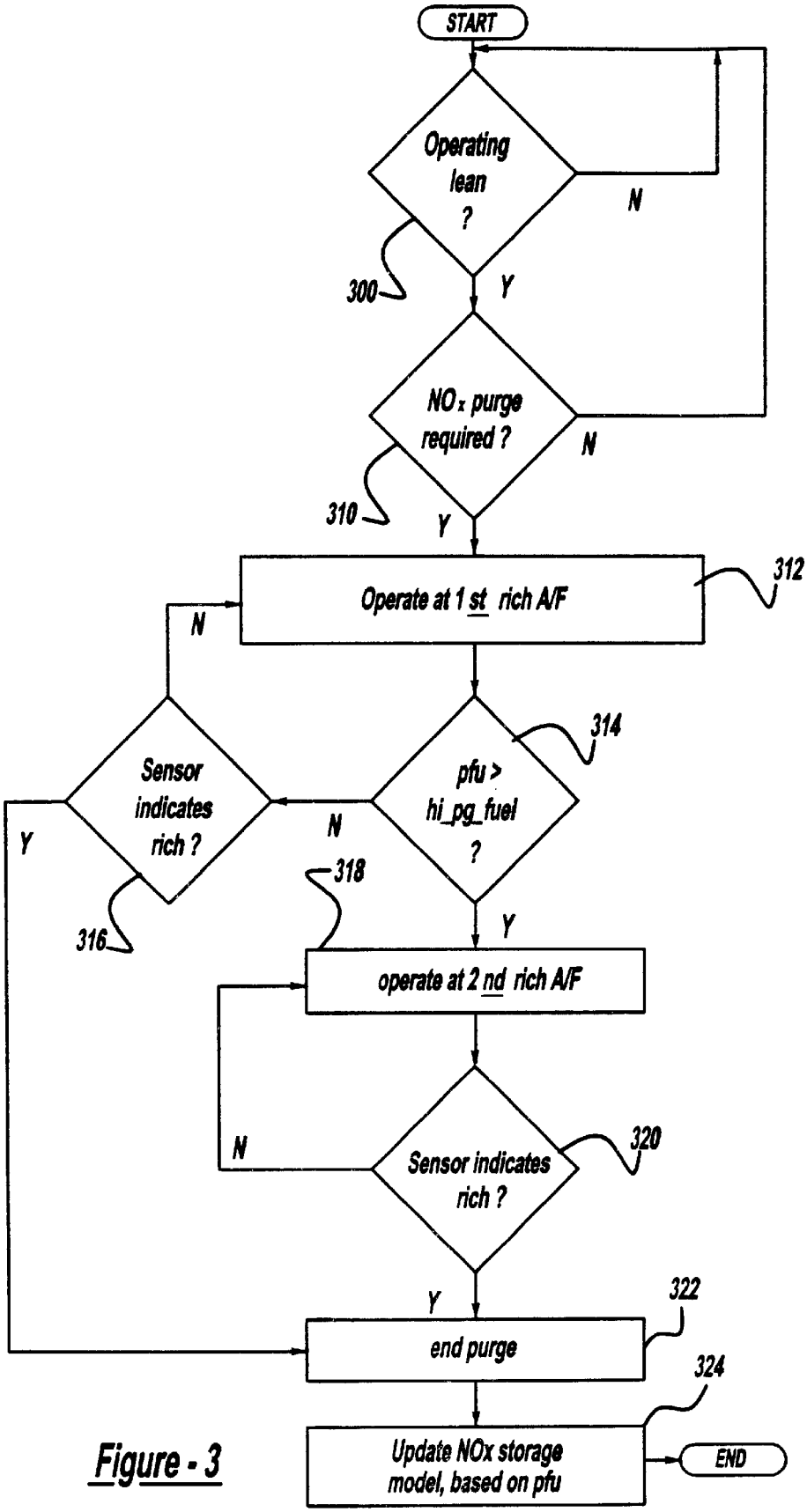
FIGS. 3–6 are high level flow charts of various operations performed by a portion of the embodiments shown in FIGS. 1 and 2.

Referring now to FIG. 3, a routine for controlling the engine is described. First, in step 300, a determination is made as to whether the engine is operating lean. When the answer to step 300 is YES, the routine continues to step 310 where a determination is made as to whether a NOx purge cycle is required. Typically, a NOx purge cycle is required when an amount of NOx stored in trap 72 reaches a predetermined level, or when an amount of NOx discharged from trap 72 per distance reaches a predetermined value. When the answer to step 310 is YES, the routine continues to step 312 where engine 10 is operated at a first rich air-fuel ratio. In this way, NOx stored in trap 72 and catalyst 70 is reduced. Typically, first rich air-fuel ratio is about a relative air-fuel ratio of 0.7. Then, in step 314, where a determination is made as to whether purge fuel used (pfu) is greater then upper fuel threshold hi_pg_fuel. Upper fuel threshold (hi_pg_fuel) is determined as described later herein with particular reference to FIG. 6. In other words, when excess fuel delivered in the exhaust to trap 72 is greater than upper fuel threshold, engine operation is changed to operate at a second rich air-fuel ratio, usually about 0.9. However, second rich air-fuel ratio can range between 0.7 and 1. Determination of extra fuel (pfu) is described later herein with particular reference to FIG. 5.

Continuing with FIG. 3, when the answer to step 314 is NO, the routine continues to step 316 to determine whether sensor 140 indicates rich. In other words, if purge fuel is overestimated and NOx is prematurely purged, the purge is ended in step 322. Otherwise, in step 318, the engine is then operated at the second rich air-fuel ratio. This operation is continued until sensor 140 indicates rich in step 320 and then the purge is ended in step 322. Then, in step 324, the NOx storage model is updated based on the total fuel used to purge trap 72 as described later herein with particular reference to FIG. 4.

Thus, according to the present invention, during trap purging, the engine is first operated at a first rich air-fuel ratio until purge fuel used reaches a threshold. Then, the engine is operated at a second rich air-fuel ratio until the trap is purged as indicated by a downstream air-fuel ratio sensor changing to rich.

Figure 4:
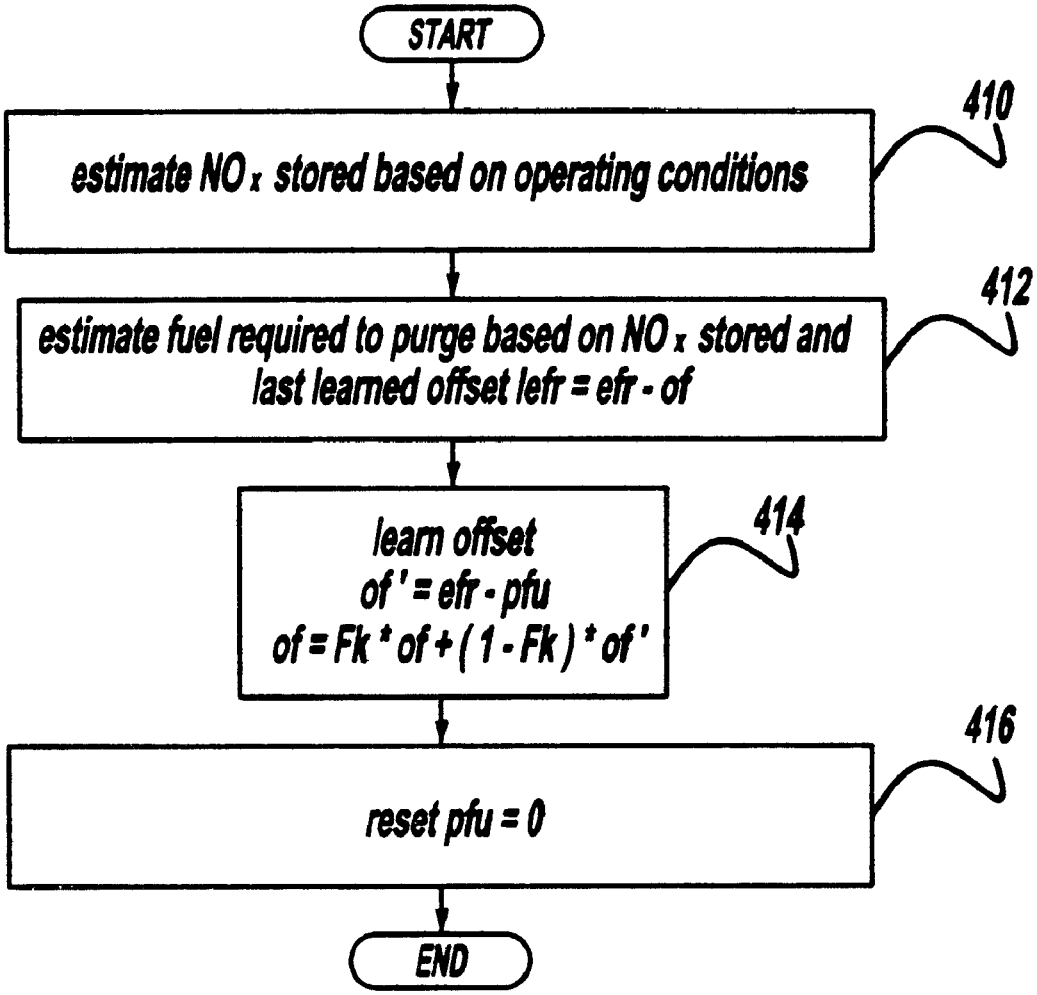

Referring now to FIG. 4, in step 410, a NOx estimation model is used to estimate NOx stored in trap 72 based on current operating conditions. These operating conditions include engine airflow, fuel injection amount, ignition timing, exhaust gas recirculation amount, engine speed, and temperatures. Then, in step 412, an estimate of fuel required to purge the stored NOx is determined at the start of the NOx purge. In general terms, a predetermined ratio as a function of trap 72 temperature is used to convert total stored NOx to a total required fuel amount estimate (efr). Then, the previously learned offset value (of) is subtracted to provide the adapted total required fuel amount estimate (lefr). This parameter is used as described later herein with particular reference to FIG. 6 to determine threshold (hi_pg_fuel).

Continuing with FIG. 4, in step 414, at the end of the trap purge, a new offset value is learned based on the total fuel used to complete the purge (pfu) (determine from the fuel injection pulse width, fpw) and the estimate of the total fuel required (efr) using the following equations:

$$of'=efr-pfu$$

$$of=fk*of+(1-fk)*of'$$

where fk is a filter coefficient between zero and 1.

Then, in step 416, total purge fuel used is reset to zero.

Figure 5:
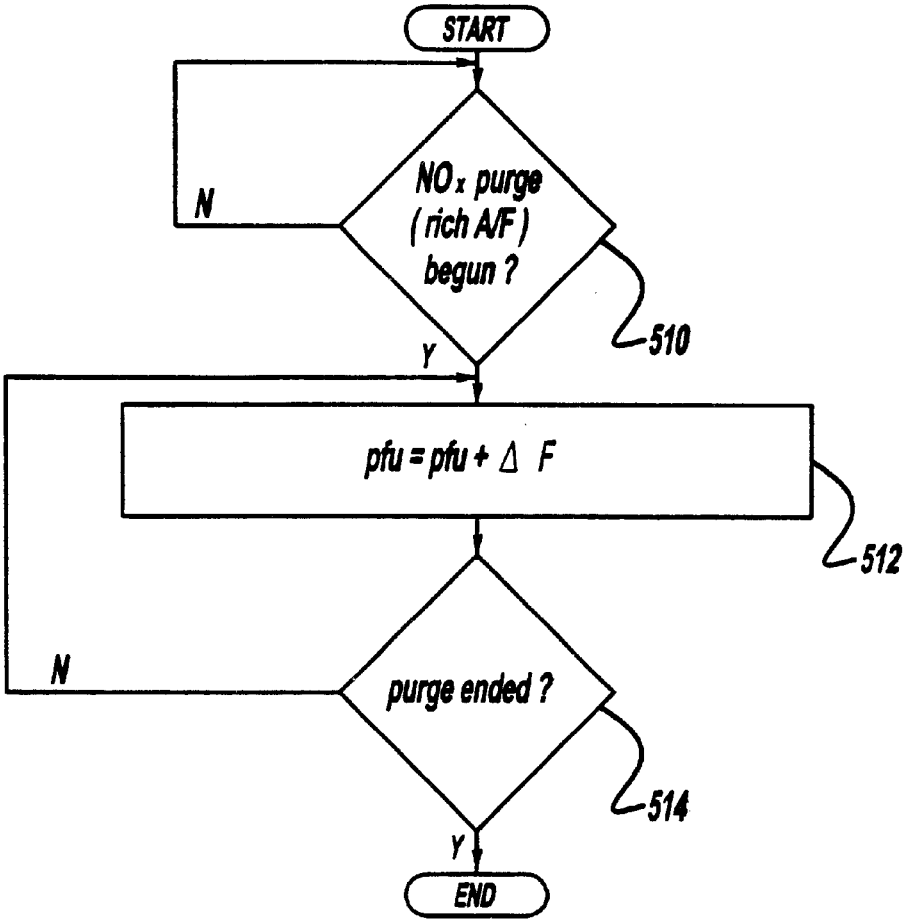

Referring now to FIG. 5, actual purge fuel used (pfu) is determined. First, in step 510, a determination is made as to whether NOx purge has begun. When the answer to step 510 is YES, the routine continues to step 512. In step 512, purge fuel used is incremented based on the excess fuel supplied to the exhaust over the last sample interval as described in the equations below.

$$\Delta f=m_{air}(1-\lambda)\lambda\lambda_s$$

where $\Delta f$ is the total fuel injected during the sample interval based on fuel pulse width (fpw), $m_{air}$ is the air charge for the current sample interval, $\lambda$ is the engine relative air-fuel ratio, and $\lambda_s$ is the stoichiometric air-fuel ratio.

The integrated excess fuel is determined as:

$$pfu=pfu+\Delta f$$

This process is repeated until the purge cycle has ended as represented by step 514.

Figure 6:
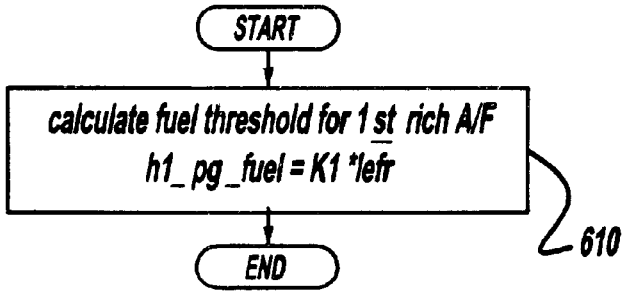

Referring now to FIG. 6, in step 610 fuel threshold (hi_pg_fuel) is determined as a percentage (K1) of the adapted total required fuel amount estimate (lefr). Typically, the percentage is greater than 50%. Thus, when the total excess fuel supplied to the exhaust (pfu) reaches a predetermined percentage of the adapted estimate of the total required to complete the purge, the engine air-fuel ratio is made less rich. Thus, when the air-fuel ratio downstream of trap 72 switches to rich, only a small amount of excess fuel is in the exhaust and over-purging is minimized. Stated another way, less extra fuel is used because the air-fuel ratio is only slightly rich at the end of the purge. However, purge time is still kept short since a majority of the purge is done at the first, richer, air-fuel ratio.

Figure 7:
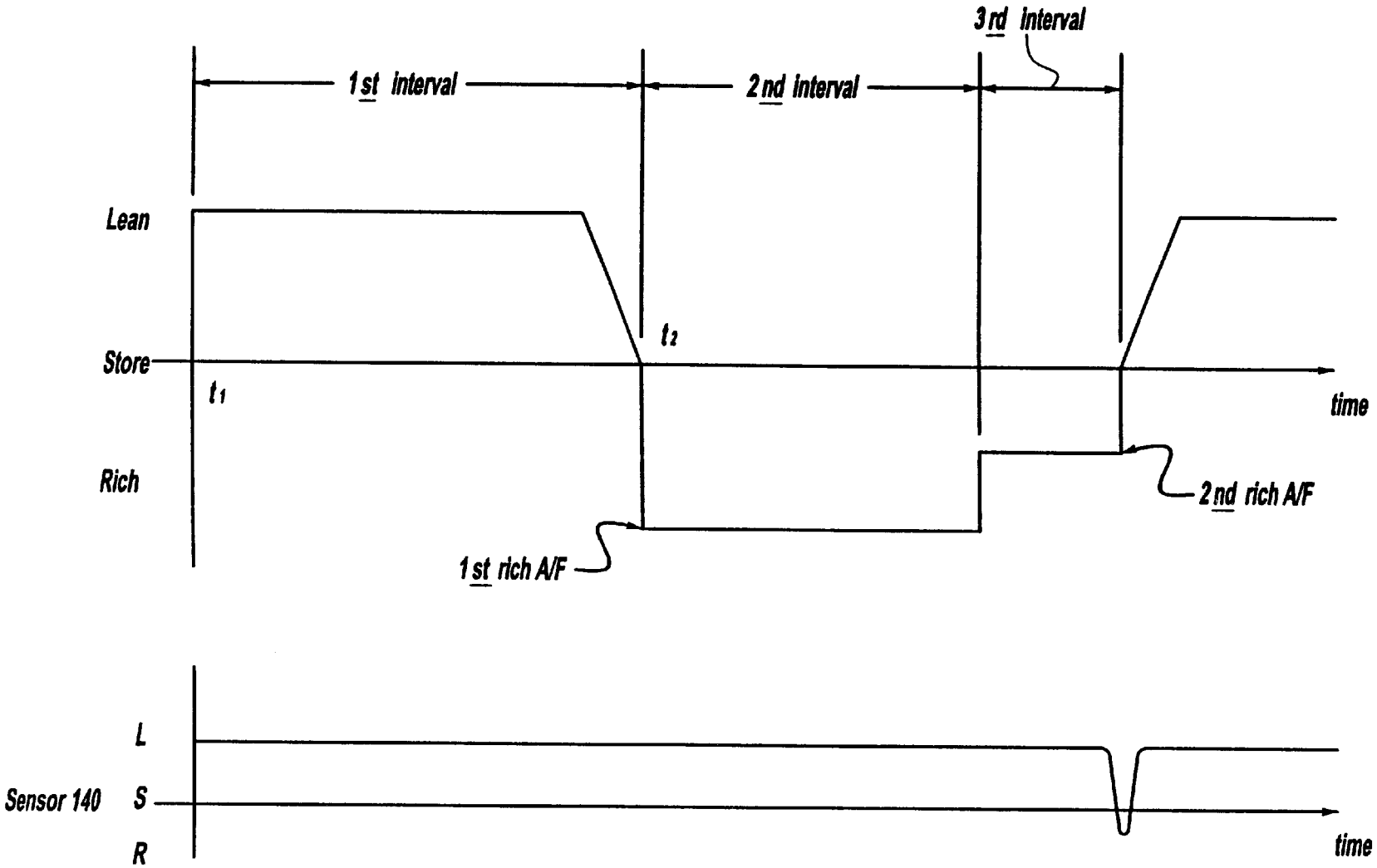
FIG. 7 is a graph illustrating operation according to the present invention.

Referring now to FIG. 7, an example of operation according to the present invention is now described. In the upper graph, engine air-fuel ratio is shown versus time. At time t1, during the first interval, the engine is operating lean and NOx trap 72 is storing NOx. Similarly, sensor 140 is indicating a lean air-fuel ratio. At time t2, during the second interval, the engine is operated at the first rich air-fuel ratio until time t3. At time t3, during the third interval, purge fuel provided reaches a percentage of estimated total fuel required and the engine is operated at the second rich air-fuel ratio, which is closer to stoichiometry. Then, at time t4, a rich signal is provided by sensor 140 indicating purge completion and the engine is again operated lean. The cycle can then repeat.

Although several examples of embodiments which practice the invention have been described herein, there are numerous other examples which could also be described. The invention is therefore to be defined only in accordance with the following claims.

We claim:

1. A method for controlling an internal combustion engine coupled to an emission control device with an exhaust sensor coupled downstream of the emission control device, the method comprising:

operating the engine at a lean air-fuel ratio during a first interval;

determining an estimate of fuel required to reduce NOx stored in the device;

operating the engine at a first rich air-fuel ratio during a second interval following said first interval;

during said second interval, determining an actual amount of fuel used to reduce NOx stored in the device, and repeatedly monitoring whether said actual amount of fuel used is greater than a percentage of said estimate of fuel required; and operating the engine at a second rich air-fuel ratio during a third interval following said second interval when said monitoring indicates that said actual amount of fuel used is greater than a percentage of said estimate of fuel required, and ending said third interval based on the downstream sensor.

2. A method for controlling an internal combustion engine coupled to an emission control device with an exhaust sensor coupled downstream of the emission control device, the method comprising:

operating the engine at a lean air-fuel ratio during a first interval, operating the engine at a first rich air-fuel ratio during a second interval following said first interval; and operating the engine at a second rich air-fuel ratio during a third interval following said second interval, wherein said second interval is ended based on an estimate of total NOx stored in the device.

3. The method recited in claim 1 wherein said third interval is ended when an output of the exhaust sensor crosses a corresponding threshold.

4. The method recited in claim 3 wherein said exhaust sensor is an air-fuel ratio sensor.

* * * * *